United States Patent [19]

Cullum

[11] Patent Number: 4,815,617

[45] Date of Patent: Mar. 28, 1989

[54] TAMPER-EVIDENT CONTAINER CAP HAVING SEALED DISC RETENTION MEANS

[75] Inventor: Douglas L. Cullum, Sunnyvale, Calif.

[73] Assignee: Cap Snap Co., San Jose, Calif.

[21] Appl. No.: 193,050

[22] Filed: May 12, 1988

[51] Int. Cl.[4] ..... B65D 41/48

[52] U.S. Cl. ..... 215/232; 215/256; 215/350; 215/348

[58] Field of Search ..... 215/232, 350, 348, 256

[56] References Cited

U.S. PATENT DOCUMENTS

| | | | |
|---|---|---|---|
| 3,861,549 | 1/1975 | Watson et al. | 215/232 |
| 4,166,552 | 9/1979 | Faulstich | 215/256 |
| 4,484,687 | 11/1984 | Bullock | 215/256 |
| 4,676,389 | 6/1987 | Bullock | 215/232 |
| 4,691,834 | 9/1987 | Bullock | 215/256 X |
| 4,699,287 | 10/1987 | Bullock | 215/256 |
| 4,722,448 | 2/1988 | Nolan | 215/232 |

*Primary Examiner*—Donald F. Norton
*Attorney, Agent, or Firm*—Julian Caplan

[57] ABSTRACT

A commercially available seal disc of foil or thin plastic is inserted in a temper-evident plastic bottle cap prior to its being applied to a container neck. The cap has an internal, horizontal upper locking bead as well as a lower locking bead which lock under shoulders on the neck of the container. Inward-extending lugs are formed projecting inward of the upper locking beads to augment the bead sections in retaining the seal disc inside the cap. When the cap is applied to the container neck, the seal disc adheres to the container neck. Neither the internal cap beads nor the lugs interfere with retention of the disc on the neck as the cap is removed.

11 Claims, 2 Drawing Sheets

TAMPER-EVIDENT CONTAINER CAP HAVING SEALED DISC RETENTION MEANS

CROSS REFERENCE TO RELATED APPLICATIONS

This invention is an improvement upon Assignee's U.S. Pat. Nos. 4,484,687 and 4,676,389.

BACKGROUND OF THE INVENTION

This invention relates to a new and improved tamper-evident container cap having seal disc retention means.

Foil and foam plastic liner seals have been used to close the necks of containers as a means to assist detecting tampering with the contents of the container. Such seals are commercially available, are applied to the container neck and are caused to adhere thereto by induction heating or other means. To facilitate installation on the container neck, the seal disc is preferably initially inserted in the cap of the present invention at the time of manufacture of the cap. After the cap has been applied to the container neck, the foil seal comes into contact with the neck. Induction heating or other means then causes the seal disc to adhere to the neck finish. One of the features of the cap hereinafter described is the formation of the upper internal locking bead with inward-projecting lugs at either end of the locking bead section. The upper bead, as well as the inward-projecting lugs, hold the liner seal in place prior to the cap being applied to the container. Thus the tendency of the seal disc to be dislodged from the cap prior to application to the container neck is overcome.

Other features and advantages of the invention are set forth in said U.S. Pat. Nos. 4,484,687 and 4,676,389, both of which disclose interrupted upper seal beads on the interior of the cap skirt, as well as the use of seal discs.

Other objects of the present invention will become apparent upon reading the following specification and referring to the accompanying drawings in which similar characters of reference represent corresponding parts in each of the several views.

IN THE DRAWINGS

Figure 1:
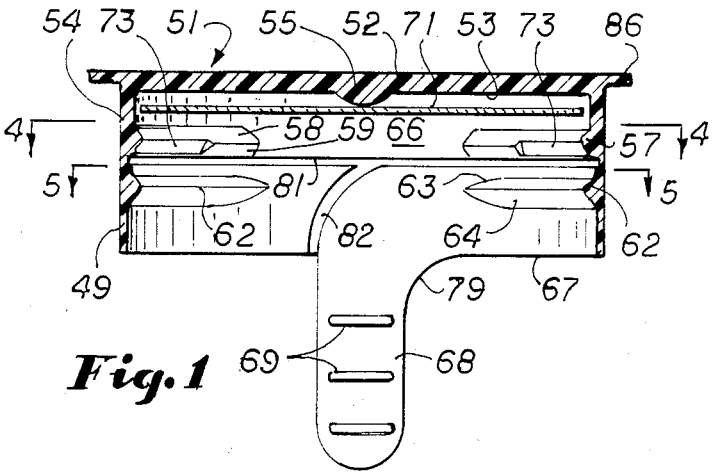
FIG. 1 is a vertical mid-section through the cap and disc of the present invention.
Figure 4:
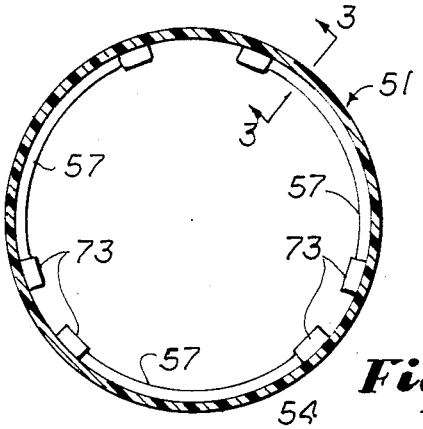
Figure 5:
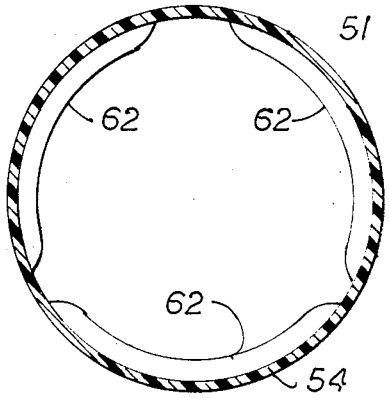

FIGS. 4 and 5 are, respectively, sectional views taken substantially along the lines 4—4 and 5—5 of FIG. 1.

Figure 6:
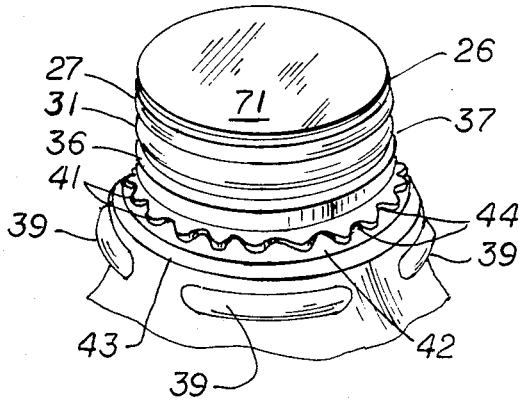

FIG. 6 is a fragmentary perspective view showing the seal disc applied to a container neck after the cap has been removed.

Figure 8:
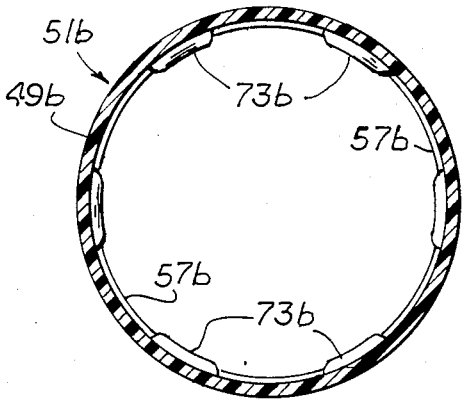
Figure 7:
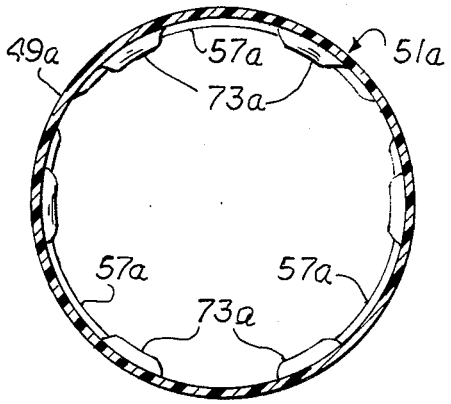

FIGS. 7 and 8 are views similar to FIG. 4 of modifications.

DESCRIPTION OF THE PREFERRED EMBODIMENT

Figure 2:
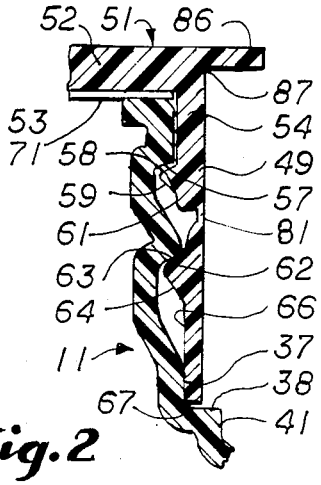
FIG. 2 is a fragmentary vertical sectional view showing the cap and disc applied to a container neck.
Figure 3:
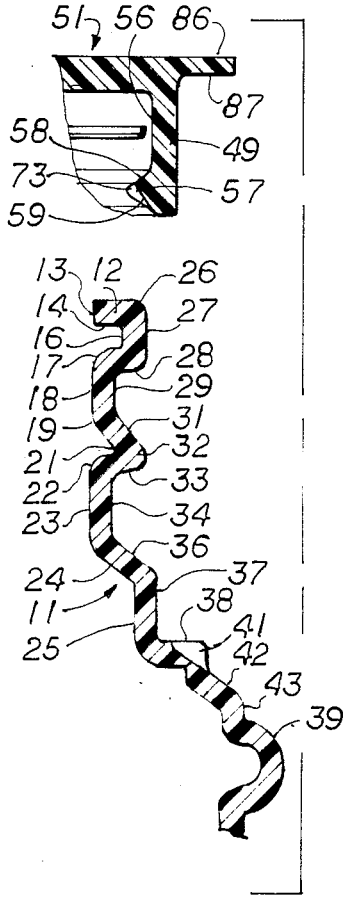
FIG. 3 is an exploded fragmentary sectional view of the cap and disc and neck prior to assembly.

The container neck 11 with which the cap of the present invention is used is shown in detail in FIGS. 2 and 3. Neck 11 has a thin, inward-extending horizontal top flange 12 which terminates in a substantially vertical top edge 13. Below edge 13 of flange 12 is a substantially horizontally outwardly extending surface 14 which terminates in top internal groove 16. Below groove 16, the inside wall of neck 11 slants downwardly-inwardly in a curved surface 17, terminating in a vertical wall 18. Below wall 18 is a second internal groove 21 joined to surface 18 by a downward-outward slanted surface 19. Below groove 21 is downwardly-inwardly rounded surface 22, which terminates in a vertical wall 23. At the lower end of wall 23 is an outwardly-downwardly slanted wall 24 which, in turn, terminates in an internal-vertical wall 25. Below wall 25, the inner wall of neck 11 conforms to the exterior (hereinafter described in detail) with a preferably uniform wall thickness throughout. The internal structure of neck is subject to considerable variation.

Directing attention now to the exterior of neck 11, the top corner 26 where flange 12 originates is slightly rounded and merges into top external vertical wall 27. Horizontal inwardly directed shoulder 28 is formed at the bottom of wall 27 and merges into a vertical wall 29, which is of lesser diameter than the wall 27. Surfaces 27 and 29 define upper locking bead 30. Below wall 29 is a downwardly-outwardly slanted wall 31, which comprises the top surface of the lower external locking bead 32. The lower edge of bead 32 comprises a substantially horizontal shoulder 33. Below shoulder 33 is a third external vertical wall 34, which is of a slightly lesser diameter than wall 29. Below wall 34 is an outward-downward slanted wall 36, which terminates in fourth external vertical wall 37, which has a diameter greater than wall 27 or bead 32. In the form of neck shown in FIGS. 2 and 3, there is a horizontal outward-extending shoulder 38 at the lower end of wall 37, against which the lower edge 67 of the cap 51 (hereinafter described) seats. Shoulder 38 consists of a plurality of circumferentially spaced protrusions 41 separated by gaps 44. The width of gaps 44 is insufficient to permit fingernails or a prying instrument to be inserted under the lower edge of the cap skirt to pry the skirt off prior to tearing thereof. Below shoulder 38 the outer wall of the neck 11 slants downward-outward in a stretch 42 and then substantially vertically downward in a short wall 43. Below the wall 43 is an outward protruding bumper ring 39 having a substantially semi-circular cross-section. Bumper ring 39 may be interrupted in a plurality of sections to provide strength resisting collapse of the bumper ring during seating of the cap on the neck. Bumper ring 39 is used in certain types of filling, capping and loading equipment whereby grippers lift the container and deposit it in a box or on a pallet. The bumper ring also prevents grippers from contacting the cap and thus reduces the chance of the cap being pulled off the neck. The shape of the exterior, as well as the interior of neck 11, is subject to variation.

Directing attention now to cap 51, the structure thereof is subject to variation and resembles that of a commercially successful cap. As best shown in FIGS. 1 and 2, cap 51 has a preferably flat top disc 52 on which a label or printed matter may be applied. The bottom 53 of disc 52 is preferably flat except for central downward protrusion 55. Depending from disk 52 is cap skirt 49, having a substantially vertical external wall 54. The inside of skirt 49 has a top internal vertical wall 56. Top locking bead means 57 are provided on the interior of skirt 49 below the wall 56 positioned to lock under the shoulder 28 in the assembled position of the cap and neck shown in FIG. 2. Bead means 57 may be continuous, but it preferably is interrupted in three (or more) circumferentially equally spaced horizontal bead sections 57, each of which has downward-inward slanted top surfaces 58 and downward-outward slanted bottom surfaces 59.

Second, or lower, bead sections 62 may be provided and these sections may be continuous or may be interrupted, as shown in FIG. 5. The interrupted sections 62 are preferably of the same length and spacing as sections 57, but this arrangement is subject to variation. The top surface 63 of each section 62 slants downward-inward and the lower surface 64 slants downward-outward.

Below bead sections 62 is a third vertical wall 66, which extends down to the bottom edge 67 of the skirt. At one location along bottom edge 67 there is a depending tear tab 68, which preferably has interior gripping ridges 69. The wall 66 is elongated so that it fits tightly against surface 37. Bottom edge 67 rests against shoulder 38 in such manner that a prying instrument may not conveniently be inserted to pull the cap off the container before it has been torn. The slanted surfaces 59 and 69 facilitate cap 51 sliding over corner 26 and the slanted surface 31 of bead 32 without splitting the skirt 49.

Spaced between the upper and lower bead sections 57, 62 is a circumferential horizontal internal scoreline 81. Extending upward from the bottom edge 67 of cap 51 in immediate proximity to one edge of tear tab 68 is a curved scoreline 82 which merges with scoreline 81. On the opposite edge of tab 68 from curved scoreline 82 the tab 68 merges with the bottom edge 67 in a curved corner 79. It will be understood that the curved scoreline 82 and radius 79 may be reversed from the positions herein shown.

A feature of the invention is that prior to the cap being applied to the neck, a seal disk 71 of any of several commercially available types is applied to the underside 53 of the top disc 52. Although, as explained in U.S. Pat. No. 4,676,389, the bead sections 57 assist in keeping the disk 71 in place prior to the cap being installed, nevertheless, particularly when the disk 71 is of a flexible material, auxiliary means are used to retain the disc in place. These auxiliary means comprise short internally extending lugs 73 at either end of the top bead section 57, which fit under the disc 71. See particularly FIGS. 1 and 3. The structure of the seal disc 71 is subject to considerable variation One type of disk has an aluminum or other metal foil structure which may or may not be laminated to a paper or fiber disc. Another type of commercially available disc is formed of a thin, foam-type plastic of polyurethane or other suitable material. Still another type of seal disc is of waxed paperboard. In any event, the underside of the disc is provided with an adhesive, preferably of a type which adheres to the flange 12 of neck 11 by induction heating.

The seal disk 71 may be of a variety of constructions. Thus a wide variety of seals manufactured by Selig Sealing Products, Inc. may be used. Such seals are laminates of

- Thin (e.g. 0.001") aluminum foil, Mylar and polyethylene or vinyl or polypropylene
- Tin foil, Mylar and a proprietary adhesive
- The preceding laminated with polypropylene or Surlyn Products of Insulec are also useful being laminates of

- Thin foil, polyester, polyelefin and adhesive
- Chipboard, wax, aluminum foil, polyester and adhesive
- Chipboard, wax, aluminum foil, adhesive
- Polyolefin foam, polyester film, aluminum foil, polyester film and adhesive The seal disk 71 or its lowermost lamina may, itself, be self-adhering. An example is ethyl vinyl acetate.

The choice of seal disk depends to a considerable extent on the composition of the neck with which the cap is to be used, the product being packaged and the efficiency of sealing required. There are numerous choices of seals. After the cap is applied to the container, induction heating or other means causes the underside of disk 71 to adhere to the flange 12. Tampering with the interior of the container may usually be detected by examination of the condition of the disc 71. It will be understood, of course, that the cap 51 may not be removed from the neck 11 without tearing along the scorelines 82 and 81, and removal of the portion of the skirt below scoreline 81 also indicates tampering.

A horizontal peripheral flange 86 projects out from the top disc 82 at the upper end of the wall 54. A sharp corner 87 is formed at the juncture of the underside of flange 86 and outer wall 54. Preferably flange 86 is sufficiently flexible so that, until scorelines 81 and 82 have been torn by pulling on the flange 83, the cap may not be pulled off the neck 11. Instead, the flange 86 bends to defeat an attempt of a dishonest person trying to tamper with the contents of the container.

Whereas in FIG. 4 lugs 73 are located at each end of each of the interrupted bead sections 57, directing attention to FIG. 7, lugs **73*a* are spaced 60° apart and hence in four instances are located at points other than an end of a section 57*a*. The advantage of the structure of FIG. 7 is that, after the lower skirt portion—i.e., the portion below score line 81—has been torn off, the remaining portion may be used as a reclosure cap. This involves frequently prying the reclosure cap off the neck. If the user lifts the reclosure cap at a point directly above two closely adjacent lugs 73, there may be an unnecessary resistance to the cap being removed because the lugs 73 as well as bead sections 57 are equally spaced, as in FIG. 7, there is less resistance prying off the reclosure cap. Furthermore, equal spacing of lugs 73*a*** decreases the pressure which must be applied during capping.

In FIGS. 1–5 upper bead sections 57 are interrupted so that there are three (more or less) such sections separated by gaps. In FIG. 8, bead **57*b* is continuous, rather than interrupted and the lugs 73*b*** are equally spaced.

In other respects the structures of FIGS. 7 and 8 resemble those of FIG. 4 and the same reference numerals followed by subscripts and b, respectively, are used to designate corresponding elements.

What is claimed is:

1. A plastic cap for sealing container necks having a top finish of the type having a top disc having a depending skirt, said skirt having first horizontal bead means extending around the inside of said skirt spaced downward from said top disc, second horizontal bead means extending around the inside of said skirt spaced downward from said first bead means, said skirt being weakened around a circumferential line between said first and second bead means, tear means connected to said skirt below said circumferential line for separating the portions of said skirt above and below said circumferential line, a seal disc underneath said top disc inside said skirt and above said first bead means, whereby when said cap is applied to said neck, said seal disc fits tightly against said top finish so that access to said neck cannot be obtained without tearing open said seal disc, said first and second bead means being engageable with third and fourth bead means, respectively, on the exterior of the neck so that said cap cannot be removed from said neck without tearing off the portion of said skirt below said circumferential line, the improvement comprising a plurality of lugs on the interior of said skirt at the elevation of said first bead means, each said lug extending inward a distance greater than the inward projection of said first bead means, said seal disc being supported by said lugs to prevent dislodgement of said seal disc from said cap prior to application to a container neck.

2. A cap according to claim 1 in which said seal disc is foil and which further comprises heat-activated adhesive on the underside of said disc to adhere to said neck finish upon being heated.

3. A cap according to claim 1 in which said seal disc is a thin layer of foam plastic and which further comprises heat-activated adhesive on the underside of said disc to adhere to said neck finish upon being heated.

4. A cap according to claim 1 in which said seal disc is laminated paperboard and which further comprises heat-activated adhesive on the underside of said disc to adhere to said neck finish upon being heated.

5. A cap according to claim 1 in which said upper bead means is divided into a plurality of bead sections separated by gaps and in which said lugs project inward from each of said bead sections.

6. A cap according to claim 5 in which there is a lug on each end of at least some of said bead sections.

7. A cap according to claim 5 in which said lugs are substantially equally spaced around said first bead means.

8. A cap according to claim 1 in which said first bead means is continuous.

9. A cap according to claim 8 in which said lugs are substantially equally spaced around said first bead means.

10. A cap according to claim 1 in which said circumferential line comprises a first scoreline formed in said skirt and said tear means comprises a second scoreline extending up from the bottom edge of said skirt and merging with said first scoreline and a tear tab extending down from said bottom edge adjacent said second scoreline.

11. In combination, a cap according to claim 1 and a container having a neck formed with said top finish and said external third and fourth bead means, said first bead means locking under said third bead means and said second bead means locking under said fourth bead means in the assembled position of said cap and neck, whereby evidence of tampering appears if an attempt is made to remove said cap from said neck without separating said skirt along said circumferential line, said seal disc adhering to said top finish after said seal disc is heated.

* * * * *